US008083607B2

(12) United States Patent
Clausen et al.

(10) Patent No.: US 8,083,607 B2
(45) **Date of Patent: *Dec. 27, 2011**

(54) IRON-TYPE GOLF CLUBS

(75) Inventors: Karl A. Clausen, Carlsbad, CA (US); Douglas E. Roberts, Carlsbad, CA (US)

(73) Assignee: Cobra Golf Incorporated, Carlsbad, CA (US)

( * ) Notice: Subject to any disclaimer, the term of this patent is extended or adjusted under 35 U.S.C. 154(b) by 59 days.

This patent is subject to a terminal disclaimer.

(21) Appl. No.: 12/337,020

(22) Filed: Dec. 17, 2008

(65) Prior Publication Data

US 2010/0041493 A1 Feb. 18, 2010

Related U.S. Application Data

(63) Continuation-in-part of application No. 12/189,827, filed on Aug. 12, 2008, now Pat. No. 7,614,962.

(51) Int. Cl.
*A63B 53/02* (2006.01)
*A63B 53/06* (2006.01)

(52) U.S. Cl. ..... 473/291; 473/334; 473/349

(58) Field of Classification Search ..... 473/287–288, 473/290–291, 307, 349, 350, 334
See application file for complete search history.

(56) References Cited

U.S. PATENT DOCUMENTS 2,328,583 A 9/1943 Reach
2,332,342 A 10/1943 Reach
2,530,446 A 11/1950 Beardsley
4,630,827 A 12/1986 Yoneyama
5,050,879 A 9/1991 Sun et al.
5,275,413 A 1/1994 Sprague
5,326,105 A 7/1994 Fenton, Jr.
5,333,872 A 8/1994 Manning et al.
5,439,223 A 8/1995 Kobayashi
5,509,660 A 4/1996 Elmer
5,549,296 A 8/1996 Gilbert
5,807,186 A 9/1998 Chen
5,938,540 A 8/1999 Lu
6,093,112 A * 7/2000 Peters et al. ..... 473/291
6,471,601 B1 10/2002 McCabe et al.
6,569,029 B1 5/2003 Hamburger
6,780,123 B2 8/2004 Hasebe
6,855,069 B2 2/2005 Nagai et al.
7,326,126 B2 * 2/2008 Holt et al. ..... 473/307
(Continued)

FOREIGN PATENT DOCUMENTS

JP 02063483 A * 3/1990
(Continued)

OTHER PUBLICATIONS

U. S. Office Action dated Apr. 21, 2010 in U.S. Appl. No. 12/610,480.
(Continued)

*Primary Examiner* — Stephen L. Blau
(74) *Attorney, Agent, or Firm* — Mark S. Leonardo; Brown Rudnick LLP

(57) ABSTRACT

The present invention is directed to an iron-type golf club that may be included in a set. In particular, the inventive golf club includes an adjustable hosel coupling and a mechanism for altering the sole configuration. The golf club may be included in a set having a progressive sole configuration that provides desired bounce for each club within the set.

13 Claims, 11 Drawing Sheets

U.S. PATENT DOCUMENTS

| | | | |
|---|---|---|---|
| 7,524,250 | B2 | 4/2009 | Soracco et al. |
| 7,614,962 | B1 | 11/2009 | Clausen |
| 7,878,920 | B2 | 2/2011 | Clausen |
| 2004/0106466 | A1 | 6/2004 | Wieland et al. |
| 2004/0157679 | A1 | 8/2004 | Poincenot et al. |
| 2007/0078030 | A1 | 4/2007 | Poincenot et al. |
| 2007/0117651 | A1 | 5/2007 | Belmont |
| 2008/0254908 | A1 | 10/2008 | Bennett et al. |

FOREIGN PATENT DOCUMENTS

| | | |
|---|---|---|
| JP | 2005-270402 | 10/2005 |

OTHER PUBLICATIONS

U. S. Notice of Allowance dated Sep. 21, 2010 in U.S. Appl. No. 12/610,480.

* cited by examiner

IRON-TYPE GOLF CLUBS

CROSS-REFERENCE TO RELATED APPLICATIONS

This application is a continuation-in-part of U.S. patent application Ser. No. 12/189,827, filed Aug. 12, 2008 now U.S. Pat. No. 7,614,962, the contents of which are incorporated in their entirety by reference herein.

FIELD OF THE INVENTION

This invention generally relates to golf clubs, and more specifically to the sole configuration of iron-type golf clubs.

BACKGROUND OF THE INVENTION

Iron-type golf clubs generally include a face that includes a ball striking surface and a body that supports the face, provides desired mass properties and includes a sole that is configured to contact the ground during a swing. The face includes a ball striking surface that generally includes a plurality of score lines or grooves that are positioned to impart spin on the ball during impact. The body is generally designed to provide mass that is distributed to tailor the behavior of the club, especially during impact with the ball. The sole configuration also dictates the behavior of the club caused by its interaction with the ground at address and during a swing.

The sole configuration of iron-type golf clubs is particularly important due to the wide variety of surfaces that the sole contacts and because if configured properly, the behavior the sole creates can protect a user from injury. The sole is usually slightly curved between a leading edge and a trailing edge so that when the club is placed on the ground the leading edge and the trailing edge are located above the ground. The angular relationship between a line extending from the leading edge to the trailing edge and the ground is traditional bounce and curvature included on the sole between the leading edge and the trailing edge affects the effective bounce of a golf club. A positive bounce corresponds to a generally forwardly inclined (i.e., the leading edge is elevated relative to the trailing edge) profile that assists in preventing the club head from digging into the ground and substantially reducing the club head speed during a swing.

Prior golf clubs have included a variety of sole configurations. For example, U.S. Pat. No. 5,549,296 to Gilbert describes a golf club that has a sole including a positive bounce surface, a trailing sole surface and a crescent surface. The crescent surface is between the positive bounce surface and the trailing sole surface and has a bounce angle that is selected so that the contact point of the golf club head at address is located in the center of a rear boundary of the crescent surface.

In another example, U.S. Pat. No. 6,471,601 to McCabe et al. describes a golf club that includes a bottom crescent surface, a positive bounce surface, a heel surface and a toe surface. The bottom crescent surface has a generally straight aft boundary that is proximate a trailing edge of the club head and a curved front boundary. The bottom crescent is also configured so that it is substantially flat with the ground at address.

There is a need for an improved golf club sole configuration for a set of iron-type golf clubs that increases balance and playability for the clubs throughout the set.

SUMMARY OF THE INVENTION

The present invention is directed to a set of iron-type golf clubs. The inventive set of iron-type golf clubs provides a sole configuration that varies through the set to provide consistent balance and playability.

A set of iron-type golf clubs of the present invention, includes at least first, second and third golf clubs. The first golf club includes a first golf club head with a first loft angle, a ground contact location that is co-planar with a first center of gravity of the golf club in a vertical plane extending in a heel-toe direction, and a first sole camber having a first radius of curvature. The second golf club includes a second golf club head with a second loft angle that is greater than the first loft angle, a ground contact location that is co-planar with a second center of gravity of the second golf club head in a vertical plane extending in a heel-toe direction, and a second sole camber having a second radius of curvature that is greater than the first radius of curvature. At least one of the first golf club and the second golf club includes an adjustable hosel coupling and a removable sole member coupled to a sole portion of the respective golf club head.

An iron-type golf club of the present invention includes a golf club head, a shaft and an adjustable hosel coupling. The golf club head includes a body having a face, and a removable sole member. The adjustable hosel coupling is interposed between the golf club head and the shaft and the coupling adjustably couples the shaft to the club head.

In another aspect of the present invention, a method of constructing an iron-type golf club is provided. The method includes providing a golf club head having a body including a face, and a removable sole member; a shaft; and an adjustable hosel coupling. The adjustable hosel coupling is interposed between the golf club head and the shaft. The coupling adjustably couples the shaft to the club head. The golf club is provided in a first configuration having a first loft angle and a first face angle. The method also includes altering the adjustable hosel coupling to place the golf club in a second configuration having a second loft angle and a second face angle. Additionally, the method includes replacing the sole member with a second sole member having a ground contact location that alters the face angle from the second face angle.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

The present invention is directed to iron-type golf clubs having a progressive sole configuration through a set and to iron-type golf clubs having an adjustable sole configuration. In particular, the inventive golf clubs generally include a consistent relationship between the ground contact and center of gravity throughout the set and a progressive sole configuration that provides desired bounce for each club within the set. The progressive sole configuration includes a progressive sole camber throughout the set of iron-type golf clubs. The set may include iron-type golf clubs that provide adjustable loft, lie and/or face angle and the clubs are provided with adjustable sole components so the progressive sole configuration may be maintained through the set along with the adjustability.

Figure 1:
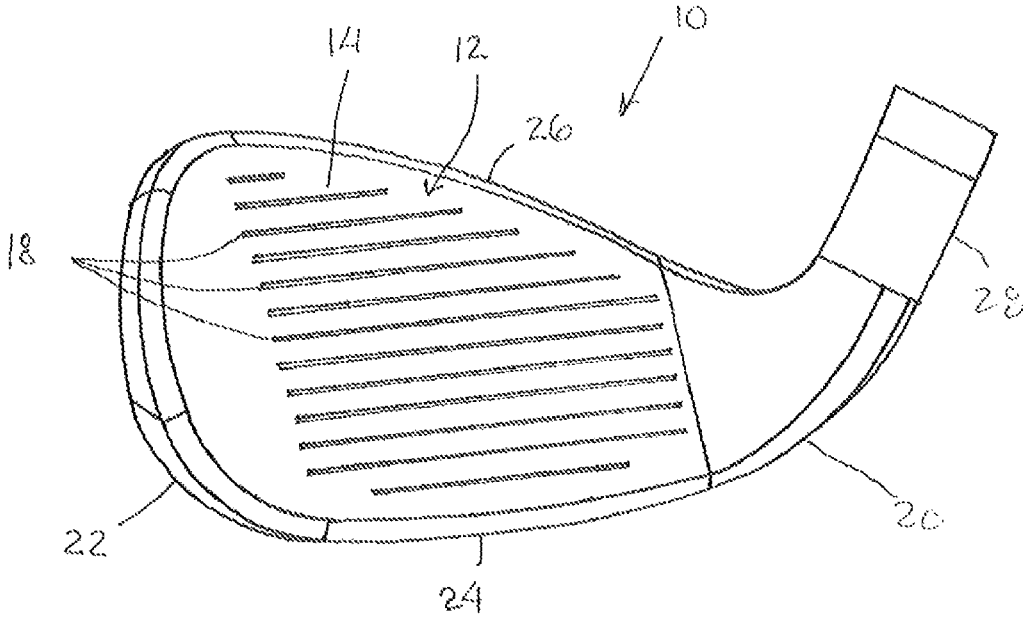
FIG. 1 is a front perspective view of an iron-type golf club in accordance with the present invention.
Figure 2:
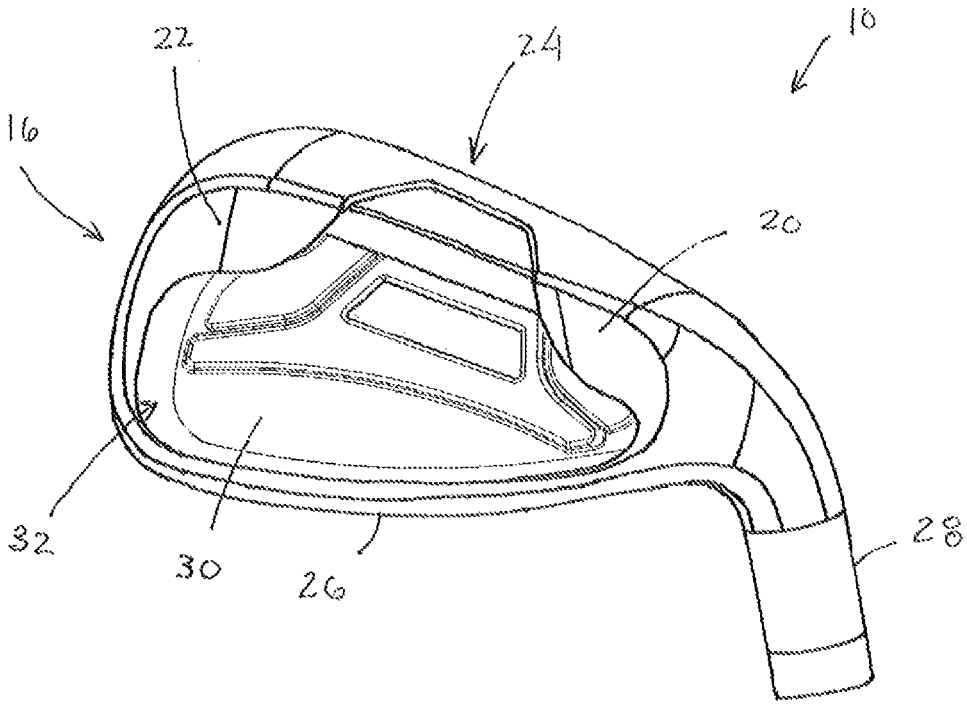
FIG. 2 is a rear perspective view of the golf club of FIG. 1.

Referring to FIGS. 1 and 2, an iron-type golf club head 10 generally includes a face 12 and a body 16 that supports face 12. Face 12 includes a generally planar ball striking surface 14 and a plurality of score lines 18, or grooves, that extend into face 12 from ball striking surface 14. Score lines 18 assist in imparting spin to a golf ball during impact and may have various configurations to produce desired spin characteristics.

In addition to providing support for face 12, body 16 provides the majority of the mass of club head 10. Body 16 is configured to distribute the mass so that club head has a desired behavior during impact with a golf ball and/or the ground during a swing. For example, body 16 may have a muscle-back or a cavity-back configuration. As shown, body 16 has a cavity-back configuration that provides perimeter weighting to increase the moment of inertia of club head 10 to add forgiveness during misaligned ball impacts. In particular, the mass of body 16 is concentrated in locations spaced from the geometric center of club head 10, such as in a heel portion 20 and a toe portion 22. Additionally, the mass of body 16 is concentrated below the geometric center in a sole portion 24 and above the geometric center in a top line portion 26, with a greater percentage of the mass located in sole portion 24 so that the height of the center of gravity of club head 10 is reduced. Body 16 also includes a hosel 28 for attaching a golf club shaft.

Face 12 and body 16 may be constructed from any metal or non-metal material and face 12 may be integrated with body into a single component or face 12 may be constructed separately and attached to body 16. Preferably, the material of face 12 has a density in the range of about 2 g/cm$^3$ to about 8 g/cm$^3$ and the material of body 16 has a density in the range of about 6 g/cm$^3$ to about 19 g/cm$^3$. Suitable materials for face 12 include metallic materials such as aluminum, stainless steel, carbon steel, titanium, magnesium, and alloys thereof; and non-metallic materials such as carbon fiber composites, plastics and fiber reinforced plastics. Suitable materials for body 16 include, but are not limited to, stainless steel, carbon steel, titanium, aluminum and alloys thereof and portions may be constructed from materials having greater density such as lead, tungsten, gold, or silver to provide a desired mass distribution.

A back plate 30 may also be attached to body 16. Back plate 30 may be coupled to any portion of body 16, such as within a cavity 32 defined by the perimeter weighting of body 16. Back plate 30 may be constructed to provide weight adjustment, vibration damping and/or desired aesthetics as will be described in greater detail below.

Figure 3:
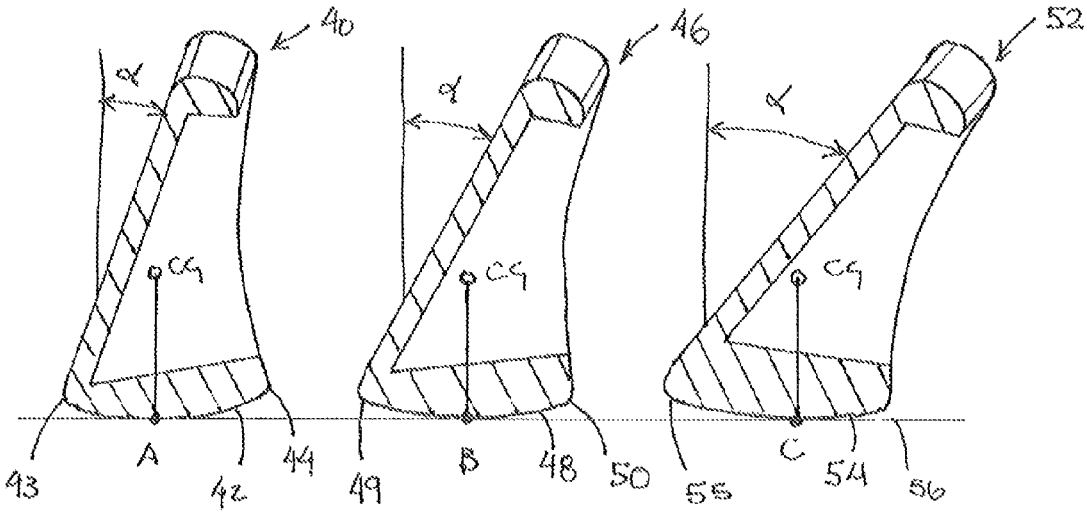
FIG. 3 is a cross-sectional view of a plurality of iron-type golf clubs included in a set in accordance with the present invention.

Referring to FIG. 3, the relationship between the location of the center of gravity and the ground contact is consistent throughout a set of iron-type golf clubs. The set of golf clubs is assembled with a plurality of golf clubs 40, 46, 52 that have progressively increasing loft angles ($\alpha$). Because of the change in loft angle, the associated mass distribution and the location of the center of gravity (CG) are unique for each club in the set. For example, golf club 40 corresponds to a long-iron and has the lowest loft angle of the clubs in the set and, in the illustrated example, sole 42 has the smallest length from the leading edge to the trailing edge (also referred to herein as sole width). Golf club 52 corresponds to a short-iron and has the greatest loft angle in the set and, in the illustrated example, sole 54 has the greatest length. Golf club 46 corresponds to a mid-iron and has an intermediate loft angle and sole 48 has an intermediate length.

The clubs of the set shown in FIG. 3 include ground contact locations that are vertically aligned with the respective center of gravity locations. Since each of the clubs has unique dimensions and a unique mass distribution the location of the ground contact varies along the length of the sole. In particular, the ground contact A of golf club 40 is located closer to leading edge 43 than trailing edge 44. The ground contact C of golf club 52 is located further from leading edge 55 than trailing edge 56. The ground contact B of golf club 46 is located approximately equidistant between leading edge 49 and trailing edge 50.

Figure 4:
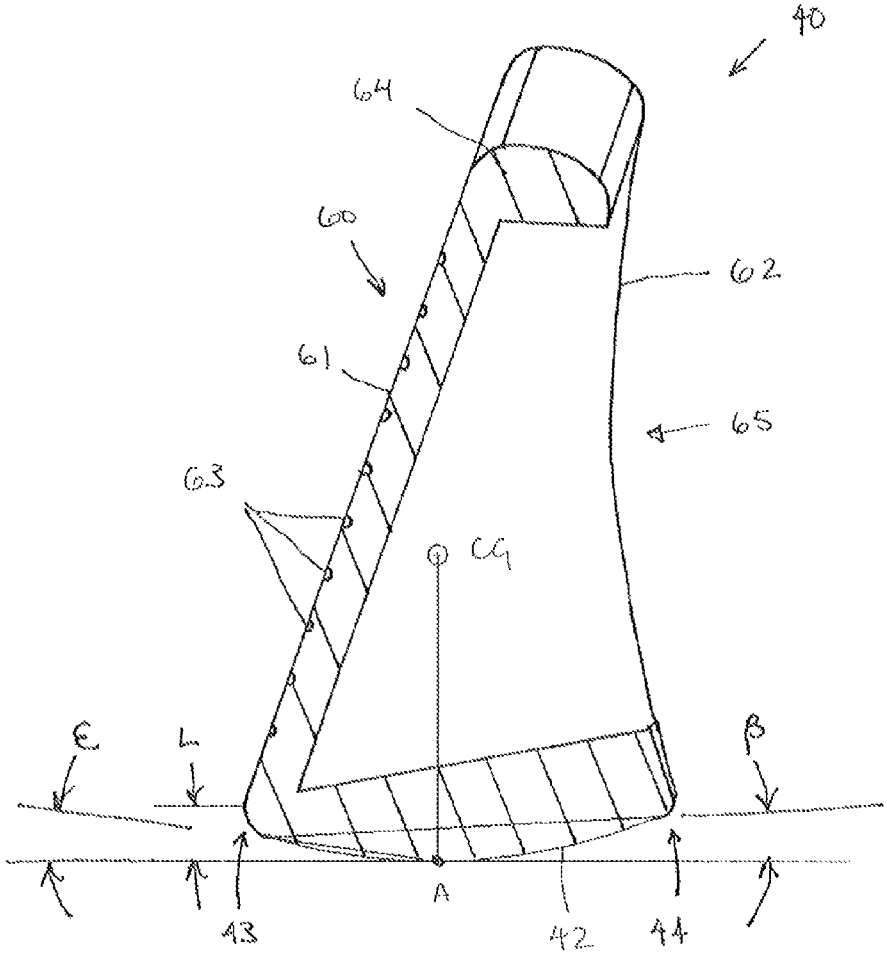
FIG. 4 is a cross-sectional view of a golf club of the set shown in FIG. 3.

The set of golf clubs of the present invention includes progressive sole camber (i.e., front to rear sole curvature) that, in concert with the traditional bounce angle provides desired effective bounce and leading edge height for each club while maintaining the unique position of the ground contact for each of the clubs of the set. Referring to FIG. 4, golf club 40 will be described in greater detail. Golf club 40 includes a face 60 and a body 62 that supports face 60. Face 60 includes a generally planar ball striking surface 61 and a plurality of score lines 63 that extend into face 60 from ball striking surface 61. Body 62 is configured as a cavity-back golf club with perimeter weighting that includes sole 42 and a top line portion 64 and that defines a cavity 65.

Sole 42 is configured to provide desired effective bounce ($\epsilon$) and leading edge height (L) while maintaining contact point A. For the purposes of this discussion, traditional bounce ($\beta$), is the angular relationship between a line extending from the leading edge to the trailing edge and the ground surface. The value of traditional bounce is positive (+) in instances wherein the leading edge is higher than the trailing edge and negative (−) in those where the leading edge is lower than the trailing edge. Effective bounce is the angular relationship between a line extending from the leading edge to the contact point and the ground surface. The leading edge height is the height from the ground to the position on the club head sole that is furthest forward. Each of these measurements is based on a non-compressible, planar ground surface with the golf club oriented with its designed loft and lie angles relative to the ground plane, although the actual ground surface during play may vary based on the conditions of the particular course.

Golf club 40 corresponds to a low-lofted, long iron, such as a 3-iron having a 20.0° loft angle. Golf club 40 has a traditional bounce of −3.0°. Sole 42 is cambered to provide an effective bounce angle of 1.0°-15.0°, preferably 7.5°-8.5°, and more preferably approximately 8.0°. In particular, the camber of sole 42 has a radius of curvature of approximately 1.2-1.8 inches, and more preferably approximately 1.5 inches. Additionally, the leading edge height is set at 0.130-0.140 inches, and more preferably at 0.136 inches. This combination of traditional bounce and sole camber results in the desired ground contact point, effective bounce, and leading edge height.

Figure 5:
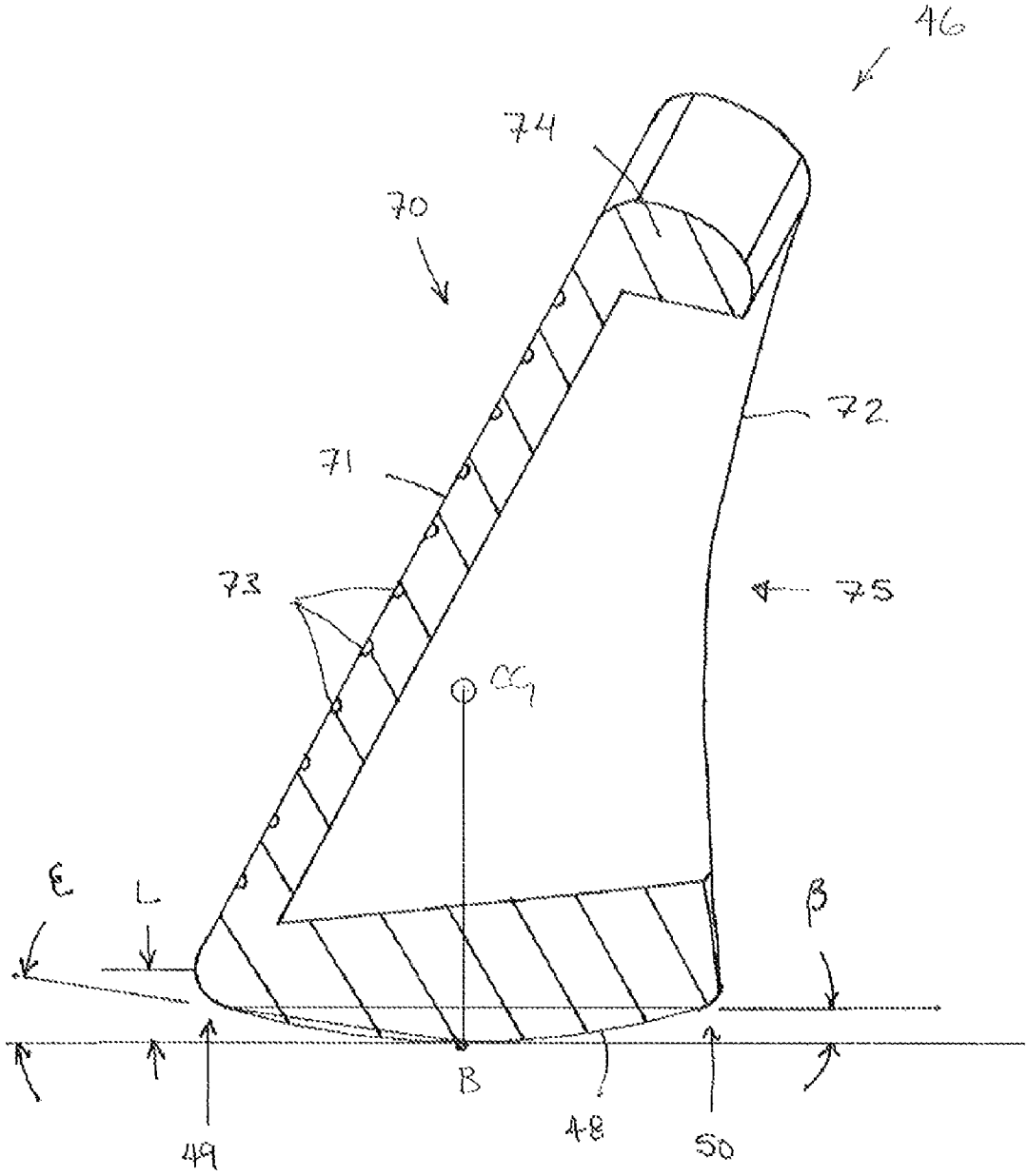
FIG. 5 is a cross-sectional view of a golf club of the set shown in FIG. 3.

Referring to FIG. 5, golf club 46 will be described in greater detail. Golf club 46 includes a face 70 and a body 72 that supports face 70. Face 70 includes a generally planar ball striking surface 71 and a plurality of score lines 73 that extend into face 70 from ball striking surface 71. Body 72 is configured as a cavity-back golf club with perimeter weighting that includes sole 48 and a top line portion 74 and that defines a cavity 75.

Golf club 46 corresponds to a mid-lofted, mid-length iron, such as a 6-iron having a 29.0° loft angle. Sole 48 is configured to provide desired effective bounce (ϵ) and leading edge height (L) while maintaining contact point B. Golf club 46 has a traditional bounce of 0.0°. Next, sole 48 is cambered to provide an effective bounce angle of 1.0°-15.0°, preferably 7.5°-8.5°, and more preferably approximately 8.2°. In particular, the camber of sole 48 has a radius of curvature of approximately 1.5-2.1 inches, and more preferably approximately 1.8 inches. The leading edge height is set at 0.145-0.155 inches, and more preferably at 0.149 inches.

Figure 6:
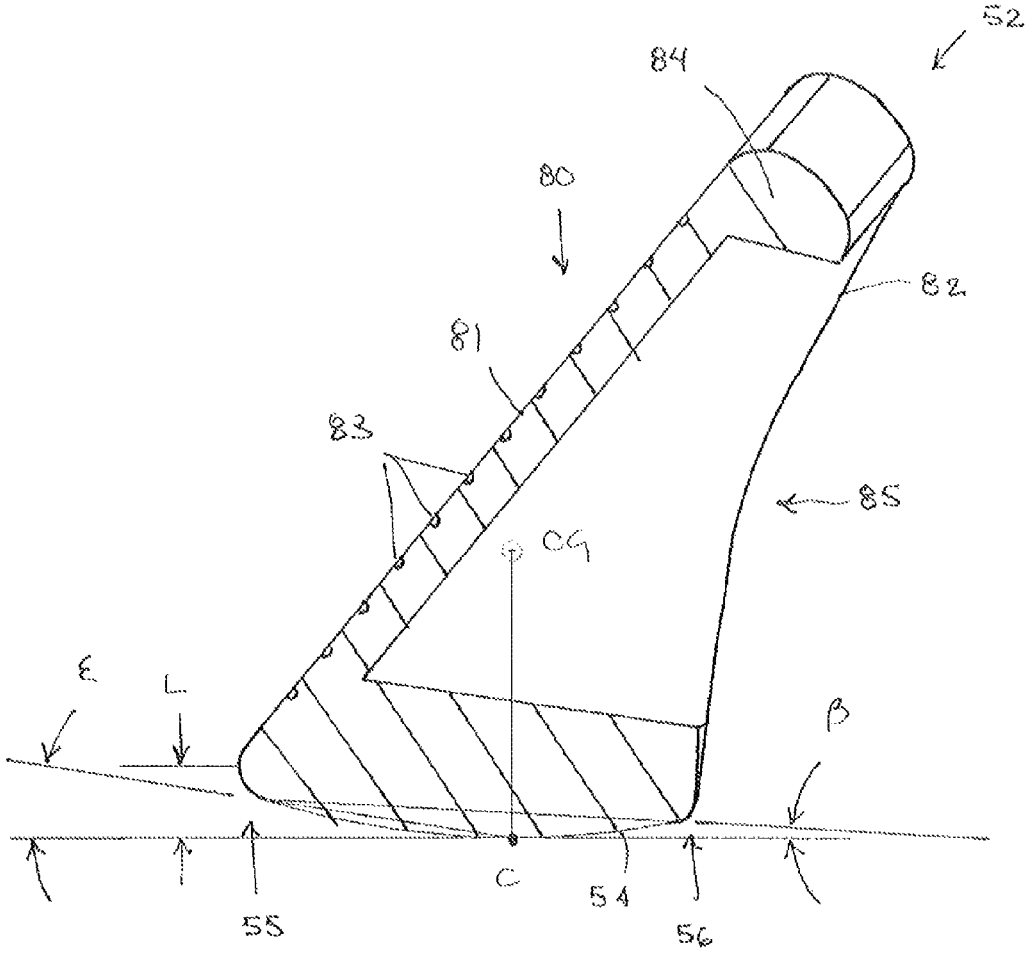
FIG. 6 is a cross-sectional view of a golf club of the set shown in FIG. 3.

Referring to FIG. 6, golf club 52 will be described in greater detail. Golf club 52 includes a face 80 and a body 82 that supports face 80. Face 80 includes a generally planar ball striking surface 81 and a plurality of score lines 83 that extend into face 80 from ball striking surface 81. Body 82 is configured as a cavity-back golf club with perimeter weighting that includes sole 54 and a top line portion 84 and that defines a cavity 85.

Golf club 52 corresponds to a high-lofted, short iron, such as a 9-iron having a 40.0° loft angle. Sole 54 is configured to provide desired effective bounce (ϵ) and leading edge height (L) while maintaining contact point B. Golf club 52 has a traditional bounce of 3.0°. The leading edge height is set at 0.165-0.175 inches, and more preferably at 0.171 inches. Next, sole 54 is cambered to provide an effective bounce angle of 1.0°-15.0°, preferably 8.0°-9.0°, and more preferably approximately 8.7°. In particular, the camber of sole 54 has a radius of curvature of approximately 1.8-2.4 inches, and more preferably approximately 2.1 inches.

Based on the exemplary set it should be appreciated that traditional bounce is used as a variable that is manipulated along with sole camber and sole width to arrive at the desired effective bounce and leading edge height. It should also be appreciated that the long-irons need not have the shortest sole width throughout the set.

Although a set of golf clubs including three clubs has been described above, it should be appreciated that a set of iron-type golf clubs may include any number of clubs. It should further be appreciated that the set of clubs may include long-irons, mid-irons, short-irons and wedges, and the clubs may have loft angles ranging from 13°-66°. The features of an exemplary set of iron-type golf clubs are included in the following table:

TABLE 1

Exemplary set of iron-type golf clubs of the present invention

| Loft Angle (α) [degrees] | Traditional Bounce (β) [degrees] | Effective Bounce (ϵ) [degrees] | Leading Edge Height (L) [inch] | Sole Camber [inch] |
|---|---|---|---|---|
| 20.0 | −3.0 | 8.0 | 0.136 | 1.5 |
| 23.0 | −2.0 | 8.0 | 0.140 | 1.6 |
| 26.0 | −1.0 | 8.1 | 0.144 | 1.7 |
| 29.0 | 0.0 | 8.2 | 0.149 | 1.8 |
| 32.5 | 1.0 | 8.3 | 0.155 | 1.9 |
| 36.0 | 2.0 | 8.5 | 0.162 | 2.0 |
| 40.0 | 3.0 | 8.7 | 0.171 | 2.1 |
| 44.0 | 4.0 | 8.9 | 0.180 | 2.2 |
| 49.0 | 5.0 | 9.2 | 0.191 | 2.3 |
| 54.0 | 6.0 | 11.2 | 0.214 | 1.9 |
| 59.0 | 6.5 | 9.4 | 0.206 | 2.5 |

The set of iron-type golf clubs of the present invention described in TABLE 1 corresponds to a set of iron-type golf clubs including 3-9 irons, a pitching wedge, a gap wedge, a sand wedge and a lob wedge, all of which have a ground contact that is vertically aligned with the location of the center of gravity of the respective club head. As shown in TABLE 1, the sole camber progressively increases throughout the set of clubs, with the exception of the sand wedge with a 54.0° loft. In that club, although the traditional bounce remains true to the progression of that feature through the set, the effective bounce is increased above the values in the progression of effective bounce through the set. That deviation is incorporated due to the nature of the use of that particular club. In particular, the bounce of a sand wedge is generally increased so that digging into soft sand is prevented. Because of that increased effective bounce and the location of the ground contact, the sole camber is decreased to 1.9 inch to provide those characteristics along with the desired leading edge height. It should be appreciated that the progressive sole camber may also be employed to increase effective bounce in a set that has traditional bounce that is constant, or has an even progression, throughout the set.

Figure 7:
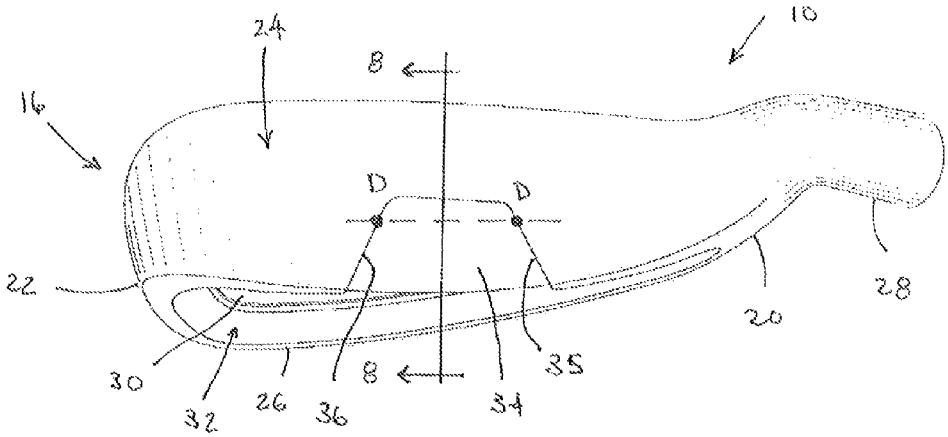
FIG. 7 is a bottom view of a golf club head in accordance with the present invention.
Figure 8:
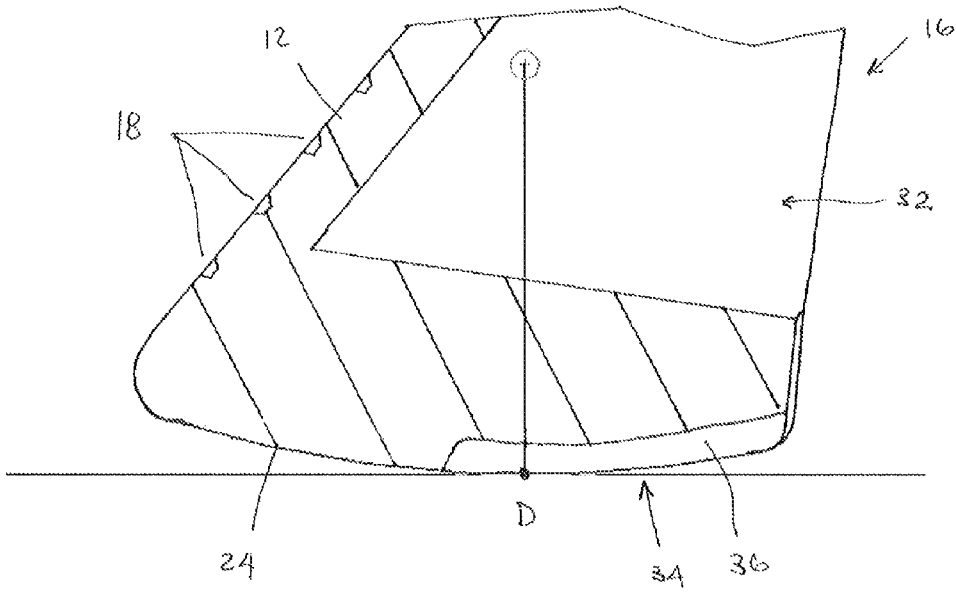
FIG. 8 is a cross-sectional view of a portion of the golf club head of FIG. 7.

Now referring to FIGS. 7 and 8, the ground contact D may include multiple contact locations. For example, club head 10 includes a sole relief 34 that forms a depression on the sole. Sole relief may extend to a location that is vertically aligned with the center of gravity of the club head so that a vertical plane extending in a heel-toe direction and extending through the center of gravity intersects relief 34. Because of the curvature of sole 24 between heel portion 20 and toe portion 22, in such an instance the edges of relief 34 form the lowest portions of sole 24 and as a result ground contact D includes locations on each of a heel edge 35 and toe edge 36 of relief 34. Providing a ground contact having multiple contact locations provides an added benefit of increased stability at address in a heel to toe direction.

Traditionally, a set of iron-type golf clubs are not configured so that the contact point is co-planar with the center of gravity in a vertical plane extending in a heel-toe direction throughout the set. As a result, the golf clubs have a tendency to rotate so that the face angle is either opened or closed at address. In the above described embodiments, the ground contact and the center of gravity are co-planar in a vertical plane extending in a heel-toe direction so that the club heads included throughout the set do not have a tendency to rotate at address. However, it should be appreciated that the ground contact may be located in a spaced relationship relative to a vertical plane extending in a heel-toe direction and extending through the center of gravity. For example, the ground contact may be spaced horizontally either forward or rearward of a vertical plane passing through the center of gravity. For example, the ground contact may be spaced up to 0.500 inches forward or rearward horizontally relative to the center of gravity which would allow the face angle to be designed closed or open.

Figure 9:
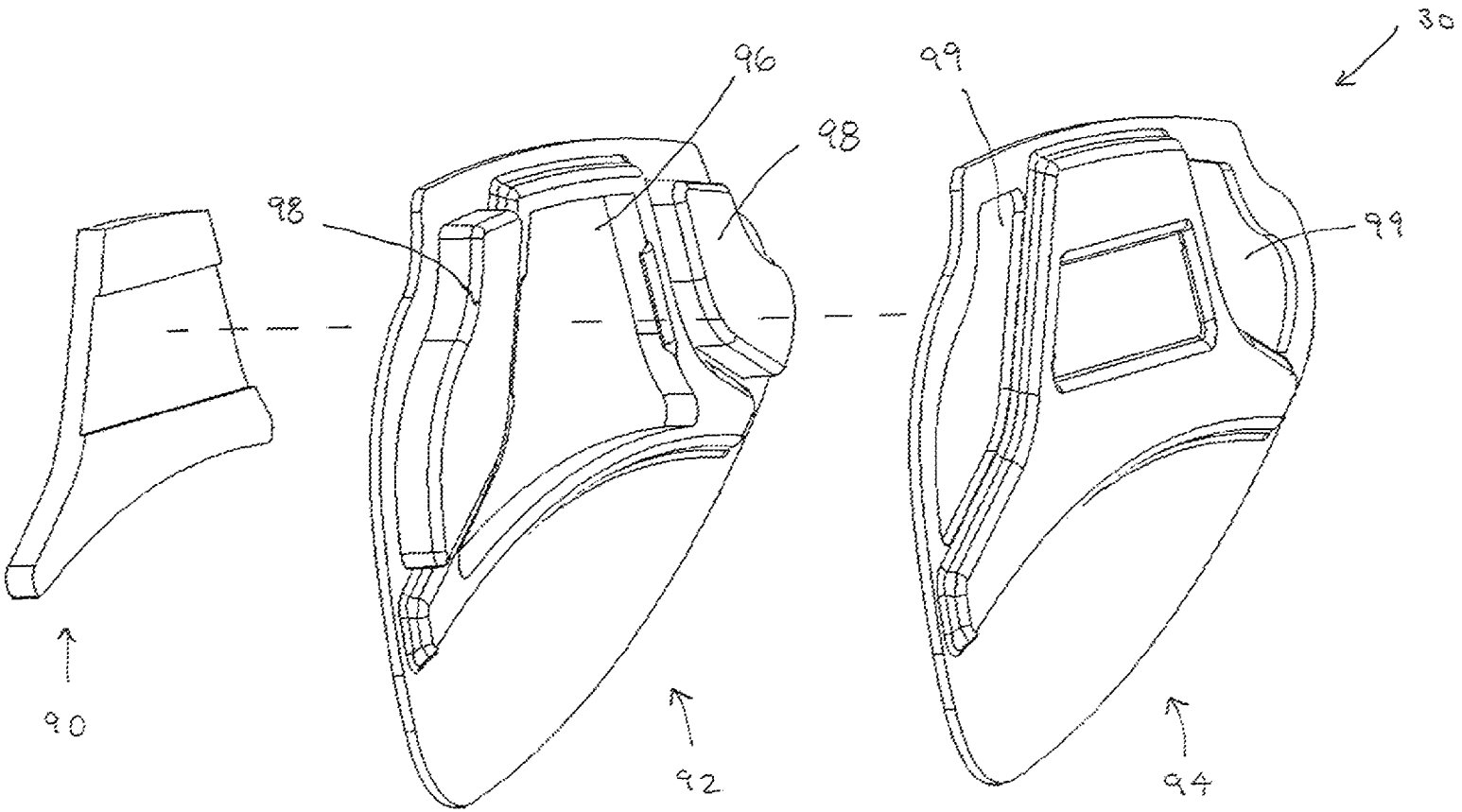
FIG. 9 is an exploded view of a back plate of a golf club in accordance with the present invention.

Back plate 30 includes a multi-piece and multi-material construction, as shown in FIG. 9, that allows for adjustment in the weight of club head 10 and offers improved vibration damping. Back plate 30 includes a weight member 90, a membrane 92 and a cover plate 94. Weight member 90 allows for the addition of weight to the club head. A plurality of weight members 90 are provided having different densities and/or volumes and during assembly a weight member 90 having a desired weight is included to bring the total club head weight to a desired value. Weight member 90 may be constructed from metal, non-metal materials or combinations of metal and non-metal materials. In one example, weight member 90 is constructed of a high density tungsten loaded polyurethane.

Membrane 92 is utilized to couple weight member 90 to cover plate 94 and to provide vibration damping. Membrane 92 includes a hole 96 that has a perimeter shape selected to complement the perimeter shape of weight member 90 and to receive it therein. Membrane 94 may have any contour and may be constructed from metal, non-metal materials or combinations, but preferably is constructed from a material having vibration damping characteristics. In the present embodiment, membrane 92 is constructed from urethane and includes thickened pad portions 98. Membrane 92 may be any shape including curved and/or linear surfaces and membrane 92 may be configured to receive a plurality of weight members 90.

Cover plate 94 covers membrane 92 and weight member 90. Cover plate 94 is coupled to at least a portion of membrane 92 and sandwiches at least a portion of membrane 92 and weight member 90 with the club head body in an assembled golf club head. Cover plate 94 may have any contour. In the present embodiment, cover plate 94 includes holes 99 that receive pads 98 of membrane 96 in the assembled back plate 30 so that pads 98 are exposed. Cover plate 94 may be constructed from metal, non-metal materials or combinations thereof. In the present embodiment, cover plate 94 is constructed from stamped aluminum and provides additional vibration damping.

Figure 10:
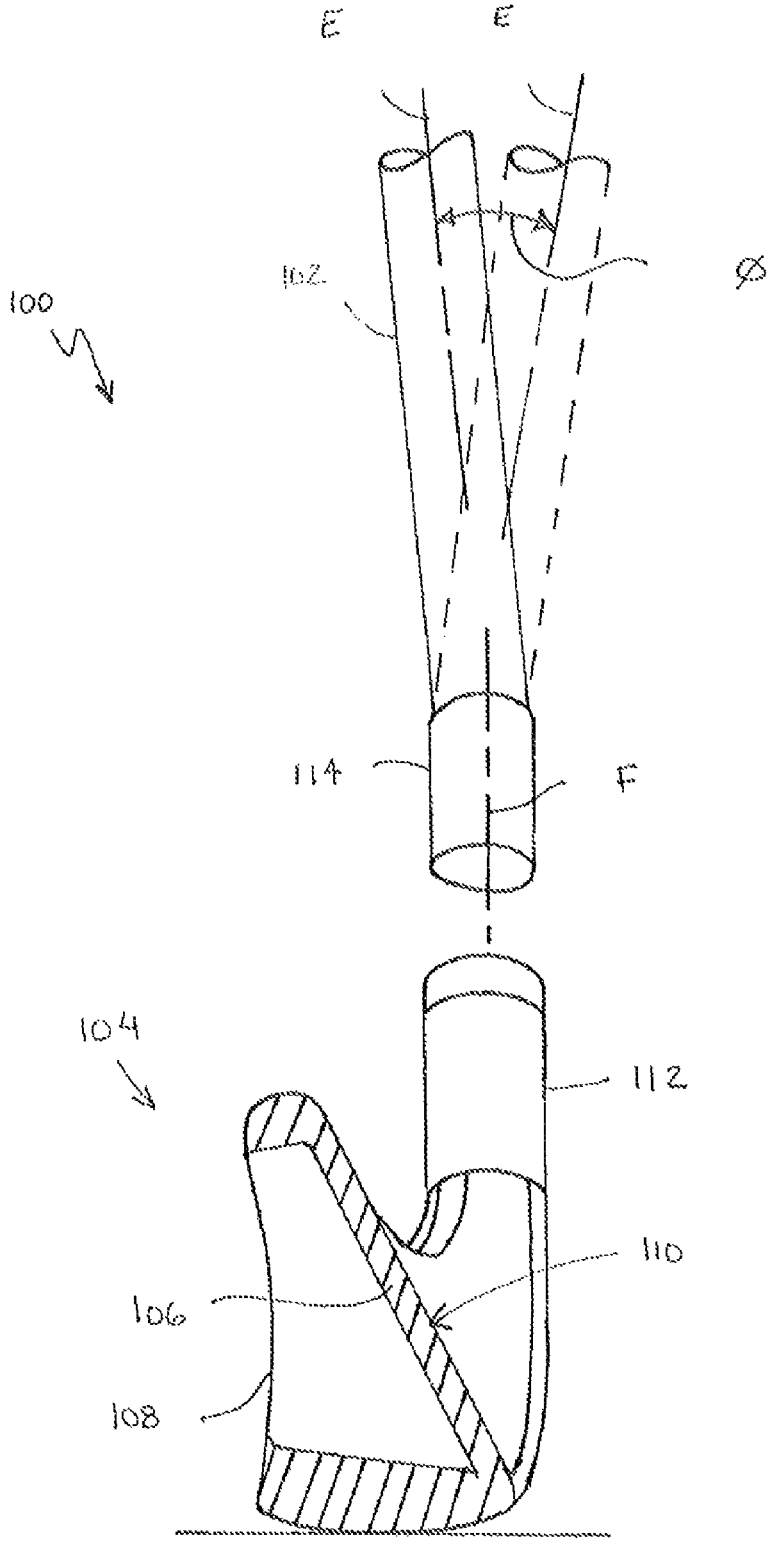
FIG. 10 is a partial cross-sectional view of a golf club of the present invention.
Figure 11:
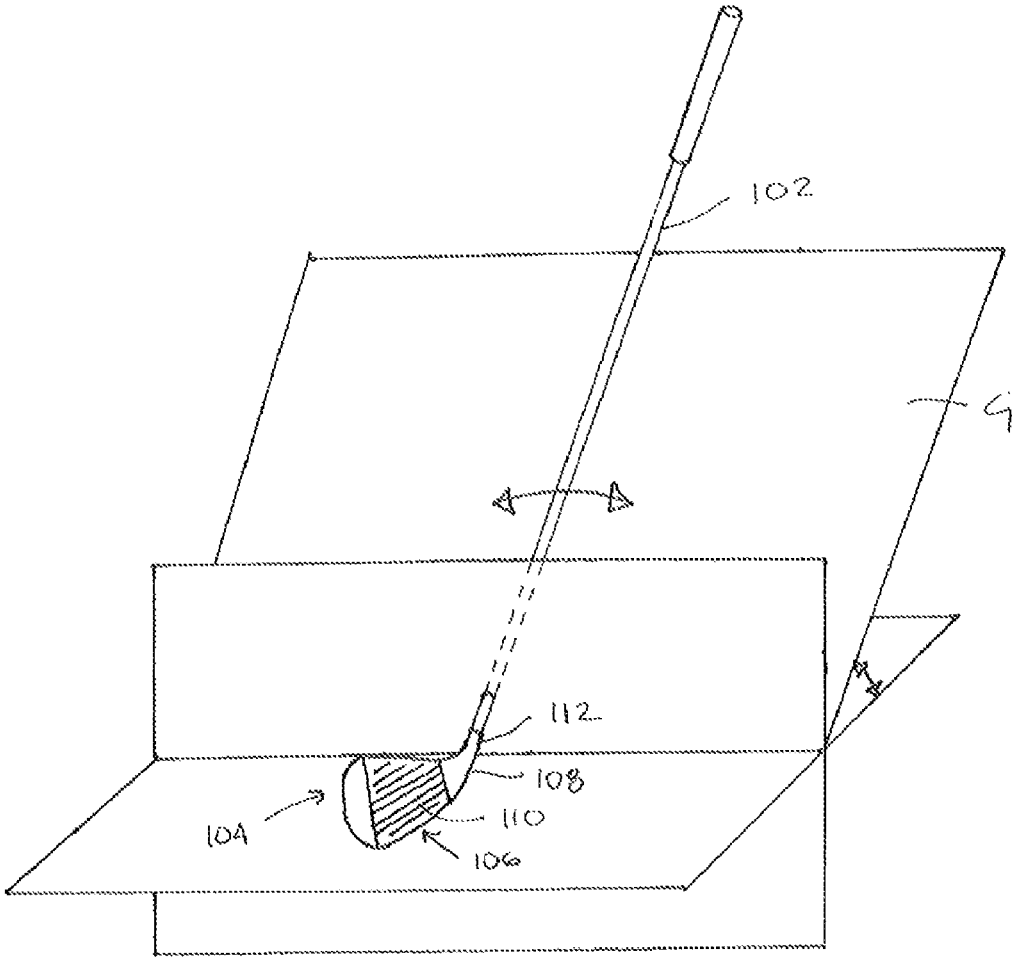
FIG. 11 is a perspective view of a golf club.

It is often desirable to alter the loft angle and/or face angle of a golf club. In other embodiments, the golf club is provided with an adjustable shaft and replaceable sole piece that allows for customization of the club. Referring to FIGS. 10 and 11, in an embodiment, a shaft 102 is provided in golf club 100 that may be fixed to club head 104 in at least two different angular configurations.

Golf club head 104 generally includes a face 106 that provides a generally planar ball striking surface 110 and a body 108 that supports face 106 and includes a hosel 112 for attaching shaft 102 to club head 104. Face 106 and body 108 may be constructed from any metal or non-metal material and face 106 may be integrated with body into a single component or face 106 may be constructed separately and attached to body 108.

Shaft 102 includes a hosel attachment member 114 that interfaces with hosel 112 when golf club 100 is assembled. As shown, attachment member 114 is a generally cylindrical member that is received in a bore of hosel 112 and coupled thereto so that attachment member 114 and hosel 112 are generally coaxially aligned. Shaft 102 is coupled to attachment member 114 so that a longitudinal axis E of shaft 102 is angled relative to a longitudinal axis F of attachment member 114. As a result, when attachment member 114 is coupled to hosel 112, longitudinal axis E of shaft 102 is angled relative to the longitudinal axis of hosel 112.

The direction of the angular relationship between hosel 112 and shaft 102 may be altered by coupling attachment member 114 to hosel 112 in various rotational positions and attachment member 114 and hosel 112 may be indexed so that they may be attached in a plurality of predetermined configurations. For example, in an embodiment, hosel 112 and attachment member 114 are configured so that the angular relationship between shaft 102 and hosel 112 may be altered over a range $\phi$ of 1°-6°. In particular, and as shown in FIG. 10, shaft 102 may be positioned so that it is in a positive and negative angle relative to axis F, which correspond to positions that are rotated rearward and forward relative to club head 104.

The removable coupling between shaft 102 and club head 104 may have any configuration. For example, the coupling may include a sleeve attached to a tip end of the shaft that engages and is coupled to a hosel of a golf club head as shown and described in co-pending U.S. patent application Ser. No. 12/023,402, filed Jan. 31, 2008 and entitled Interchangeable Shaft System.

As shown in FIG. 11, the removable coupling may be configured so that the shaft may be placed into two predetermined configurations relative to club head 104 within a lie plane G. Lie plane G corresponds to a plane that extends through the longitudinal axis of hosel 112 and lie plane G is oriented so that it is rotated relative to the ground plane by an angle corresponding to the desired lie angle of golf club 100. Because the lie angle of a golf club is generally in a range of 50-80° adjustment of the angular relationship between the club head and the shaft within the lie plane alters the loft angle and the face angle of the club while maintaining the lie angle constant. Additionally, for different lie angles, a constant rotational change of the shaft position in the lie plane will have different effects on the loft angle and face angle. In particular, as the lie angle is increased, change in the position of the shaft within the lie plane cause a greater change in loft angle and less of a change in face angle. Tables 2 and 3 illustrate the required change in angle of the shaft relative to the hosel for various lies to provide a 1 degree change in loft angle and face angle, respectively.

TABLE 2

Hosel Forward/Back Angle Changes for 1 Degree Change in Loft

| Lie | Hosel Forward/Back Angle Change | Desired Loft & Bounce Change | Affect On Face Angle |
|---|---|---|---|
| 50 | 1.305 | 1 | 0.839 |
| 55 | 1.221 | 1 | 0.700 |
| 55.5 | 1.213 | 1 | 0.687 |
| 56 | 1.206 | 1 | 0.675 |
| 56.5 | 1.199 | 1 | 0.662 |
| 57 | 1.192 | 1 | 0.649 |
| 57.5 | 1.186 | 1 | 0.637 |
| 58 | 1.179 | 1 | 0.625 |
| 58.5 | 1.173 | 1 | 0.613 |
| 59 | 1.167 | 1 | 0.601 |
| 59.5 | 1.161 | 1 | 0.589 |
| 60 | 1.155 | 1 | 0.577 |
| 60.5 | 1.149 | 1 | 0.566 |
| 61 | 1.143 | 1 | 0.554 |
| 61.5 | 1.138 | 1 | 0.543 |
| 62 | 1.133 | 1 | 0.532 |
| 62.5 | 1.127 | 1 | 0.521 |
| 63 | 1.122 | 1 | 0.510 |
| 63.5 | 1.117 | 1 | 0.499 |
| 64 | 1.113 | 1 | 0.488 |

TABLE 2-continued

| Hosel Forward/Back Angle Changes for 1 Degree Change in Loft | | | |
|---|---|---|---|
| Lie | Hosel Forward/Back Angle Change | Desired Loft & Bounce Change | Affect On Face Angle |
| 64.5 | 1.108 | 1 | 0.477 |
| 65 | 1.103 | 1 | 0.466 |
| 70 | 1.064 | 1 | 0.364 |
| 80 | 1.015 | 1 | 0.176 |

TABLE 3

| Hosel Forward/Back Angle Changes for 1 Degree Change in Face Angle | | | |
|---|---|---|---|
| Lie | Hosel Forward/Back Angle Change | Affect on Loft & Bounce | Desired Face Angle Change |
| 50 | 1.556 | 1.192 | 1 |
| 55 | 1.743 | 1.428 | 1 |
| 55.5 | 1.766 | 1.455 | 1 |
| 56 | 1.788 | 1.483 | 1 |
| 56.5 | 1.812 | 1.511 | 1 |
| 57 | 1.836 | 1.540 | 1 |
| 57.5 | 1.861 | 1.570 | 1 |
| 58 | 1.887 | 1.600 | 1 |
| 58.5 | 1.914 | 1.632 | 1 |
| 59 | 1.942 | 1.664 | 1 |
| 59.5 | 1.970 | 1.698 | 1 |
| 60 | 2.000 | 1.732 | 1 |
| 60.5 | 2.031 | 1.767 | 1 |
| 61 | 2.063 | 1.804 | 1 |
| 61.5 | 2.096 | 1.842 | 1 |
| 62 | 2.130 | 1.881 | 1 |
| 62.5 | 2.166 | 1.921 | 1 |
| 63 | 2.203 | 1.963 | 1 |
| 63.5 | 2.241 | 2.006 | 1 |
| 64 | 2.281 | 2.050 | 1 |
| 64.5 | 2.323 | 2.097 | 1 |
| 65 | 2.366 | 2.145 | 1 |
| 70 | 2.924 | 2.747 | 1 |
| 80 | 5.759 | 5.671 | 1 |

As discussed above, the location of the ground contact point impacts a golf club's tendency to rotate to an open or closed position. Additionally, alterations of the loft angle cause direct alteration of bounce angle. For example a 1° change in loft angle is accompanied by a 1° change in bounce angle, and a decrease in loft angle (i.e., creating stronger loft) is accompanied by a reduction in bounce. Oftentimes, it is desired to change loft angle while maintaining constant bounce and face angles. In order to provide that adjustability, in another aspect of the present invention, a removable sole member is provided in a golf club including a removable coupling so that the desired bounce and face angle may be provided. For example, a pair of sole members may be provided so that the same bounce angle may be provided for various loft angles. Additionally, the sole members may be configured to have different ground contact point locations to counteract the change in face angle caused by altering the loft. For example, if adjustment of the club causes the face of the golf club to open, the sole member may be configured so that the location of the ground contact point relative to the center of gravity of the golf club causes the face of the golf club to close.

Figure 12:
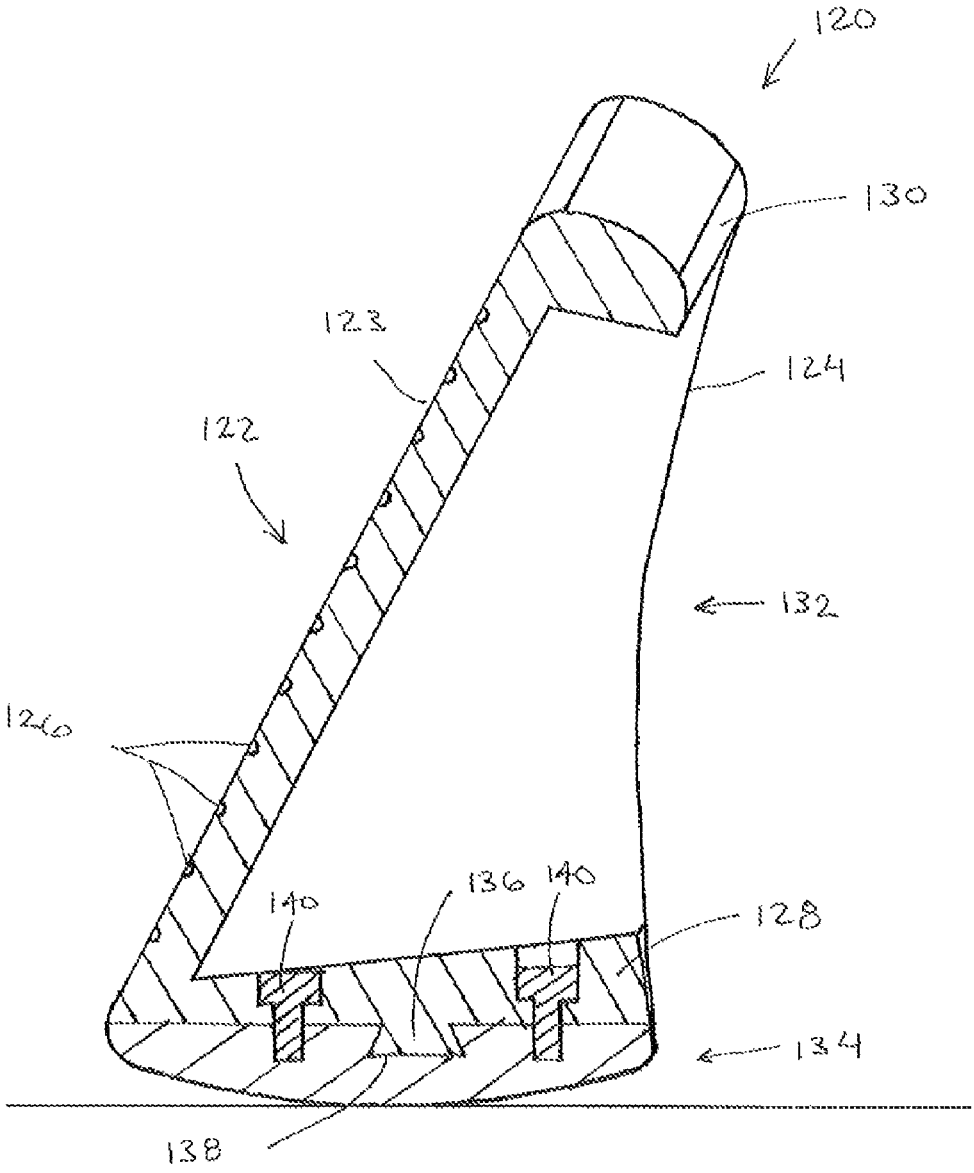
FIG. 12 is a cross-sectional view of a golf club head of the present invention.

Any structure that provides a removable coupling between the sole member and the body of the golf club may be employed. Exemplary embodiments of sole member structures will now be described with reference to FIGS. 12-14. Referring first to FIG. 12, golf club 120 includes a face 122 and a body 124 that supports face 122. Face 122 includes a generally planar ball striking surface 123 and a plurality of score lines 126 that extend into face 122 from ball striking surface 123. Body 124 is configured as a cavity-back golf club with perimeter weighting that includes sole portion 128 and a top line portion 130 and that defines a cavity 132. A sole member 134 is coupled to sole portion 128 and provides the sole surface configuration which provides the desired sole camber, bounce angle, and ground contact point among other features.

Golf club 120 corresponds to a mid-lofted, mid-length iron that includes an adjustable hosel coupling and removable sole member 134. Sole member 134 is configured to provide desired effective bounce and leading edge height while providing a contact point that results in a desired face angle. Sole member 134 is coupled to sole portion 128 so that it is fixed relative to sole portion 128 during use.

Complimentary features on sole member 134 and sole portion 128 couple the parts to prevent relative movement therebetween. In the present embodiment, sole portion 128 includes an elongated dovetail projection 136 that is received in a dovetail slot 138 included in sole member 134. The orientation of dovetail projection 136 and dovetail slot 138 results in sole member 134 being installed on sole portion 128 by aligning the complimentary features and sliding sole member 134 onto sole portion 128 in the heel to toe direction. Sole member 134 is configured so that when it is combined with sole portion 128, the sole of golf club 120 includes a desired effective bounce, leading edge height, and contact point.

Mechanical fasteners may also be employed to fix sole member 134 to sole portion 128. For example, after the complimentary features of sole member 134 and sole portion 128 are engaged, mechanical fasteners 140 are installed between sole member 134 and sole portion 128 so that the complimentary features are prevented from disengaging. Any type of mechanical fastener may be used, such as machine screws. Mechanical fasteners 140 are preferably selected so that they may be removed with a tool.

Figure 13:
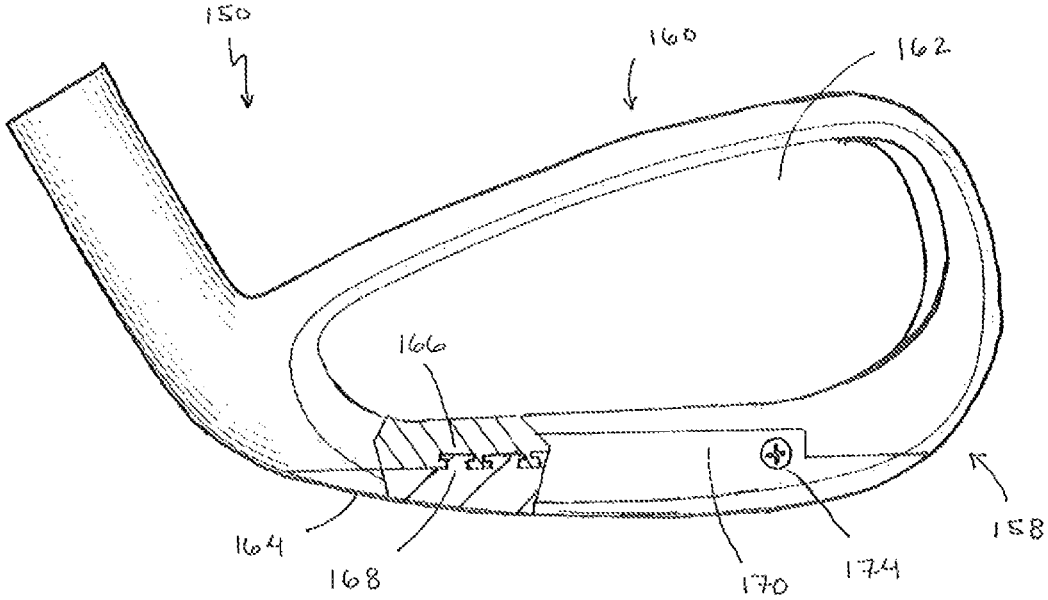
FIG. 13 is a partial cross-sectional view of a golf club head of the present invention.
Figure 14:
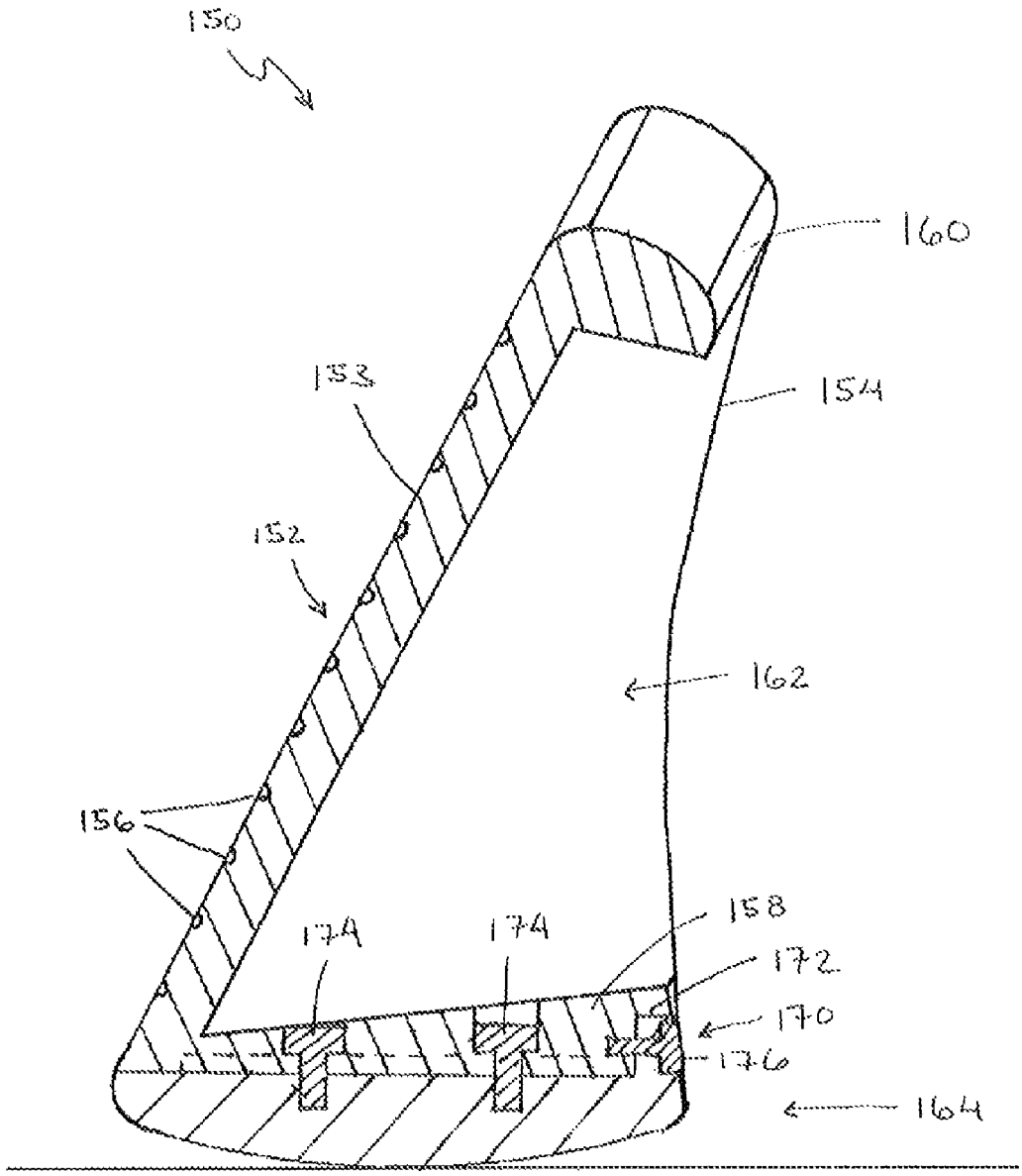
FIG. 14 is a cross-sectional view of the golf club head of FIG. 13.

Referring now to FIGS. 13 and 14, another embodiment including a removable sole member will be described. Golf club 150 includes a face 152 and a body 154 that supports face 152. Face 152 includes a generally planar ball striking surface 153 and a plurality of score lines 156 that extend into face 152 from ball striking surface 153. Body 154 is configured as a cavity-back golf club with perimeter weighting that includes sole portion 158 and a top line portion 160 and that defines a cavity 162. A sole member 164 is coupled to sole portion 158 and provides the sole surface configuration which provides the desired sole camber, bounce angle, and ground contact point among other features.

Golf club 150 corresponds to a mid-lofted, mid-length iron that includes an adjustable hosel coupling and removable sole member 164. Sole member 164 is configured to provide desired effective bounce and leading edge height while providing a contact point that results in a desired face angle. Sole member 164 is coupled to sole portion 158 so that it is fixed relative to sole portion 158 during use.

Complimentary features on sole member 164 and sole portion 158 couple the parts to prevent relative movement therebetween. In the present embodiment, sole portion 158 includes a plurality of elongate channels 166 that receive corresponding projections 168 of sole member 164. Channels 166 and projections 168 are oriented in a fore/aft direction so that they prevent relative translation between sole portion 158 and sole member 164 in the heel/toe direction and rotation between sole portion 158 and sole member 164. Additionally, sole member 164 includes a flange 170 that is received in a recess 172 of sole portion 158. Flange 170 abuts sole portion 158 within recess 172 and limits translation of sole member 164 relative to sole portion 158 and mechanical fasteners 176 may be utilized to retain flange 170 within recess 172.

Similar to the previously described embodiments, mechanical fasteners may be employed to fix sole member 164 to sole portion 158. For example, after the complimentary features of sole member 164 and sole portion 158 are engaged, mechanical fasteners 174 are installed between sole member 164 and sole portion 158 so that the complimentary features are prevented from disengaging. Fasteners 174 may be inserted from cavity 162 through sole portion 158 or through sole member 164, however, it is preferred that they are inserted through sole portion 158 from cavity 162 so that they are not exposed to the hitting surface during use. Any type of mechanical fastener may be used, such as machine screws. Mechanical fasteners 174 and 176 are preferably selected so that they may be removed with a tool.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A set of iron-type golf clubs, comprising:

a first golf club including a first golf club head having a first loft angle, a first ground contact that is co-planar with a first center of gravity of the golf club in a vertical plane extending in a heel-toe direction, and a first sole camber having a first radius of curvature;

a second golf club including a second golf club head having a second loft angle that is greater than the first loft angle, a second ground contact that is co-planar with a second center of gravity of the second golf club head in a vertical plane extending in a heel-toe direction, and a second sole camber having a second radius of curvature that is greater than the first radius of curvature;

wherein at least one of the first golf club and the second golf club includes an adjustable hosel coupling and a sole portion of the golf club head configured to receive a removable sole member;

wherein the adjustable hosel coupling has an adjustment range of at least a first position and a second position;

the first position provides the golf club with a first adjusted loft angle, the second position provides the golf club with a second adjusted loft angle;

the first adjusted loft angle and second adjusted loft angle being different;

wherein in the first position, a first removable sole member is coupled to the sole portion of the golf club head and results in a first adjusted ground contact that is co-planar with a first adjusted center of gravity of the golf club in a vertical plane extending in a heel toe direction; and, wherein in the second position, a second removable sole member is coupled to the sole portion of the golf club head and results in a second adjusted ground contact that is co-planar with a second adjusted center of gravity of the golf club in a vertical plane extending in a heel toe direction.

2. The set of golf clubs of claim 1, wherein sole member and the sole portion include complimentary interlocking features.

3. The set of golf clubs of claim 2, wherein the complimentary interlocking features include at least one projection extending from the sole portion that is received in a slot included in the sole member.

4. The set of golf clubs of claim 2, wherein the complimentary interlocking features include at least one projection extending from the sole member that is received in a slot included in the sole portion.

5. The set of golf clubs of claim 2, further comprising at least one mechanical fastener extending between the sole member and the sole portion and coupling the sole member to the sole portion.

6. The golf club of claim 1, wherein the first position further provides the golf club with a first adjusted lie angle, the second position further provides the golf club with a second adjusted lie angle;

the first adjusted lie angle and second adjusted lie angle being different.

7. The golf club of claim 1, wherein the first position further provides the golf club with a first adjusted face angle, the second position further provides the golf club with a second adjusted face angle;

the first adjusted face angle and second adjusted face angle being different.

8. The golf club of claim 1, wherein the first position further provides the golf club with a first adjusted bounce angle, the second position further provides the golf club with a second adjusted bounce angle;

the first adjusted bounce angle and second adjusted bounce angle being different.

9. A set of iron-type golf clubs, comprising:

a first golf club including a first golf club head having a first loft angle, a first ground contact that is co-planar with a first center of gravity of the golf club in a vertical plane extending in a heel-toe direction, and a first sole camber having a first radius of curvature;

a second golf club including a second golf club head having a second loft angle that is greater than the first loft angle, a second ground contact that is co-planar with a second center of gravity of the second golf club head in a vertical plane extending in a heel-toe direction, and a second sole camber having a second radius of curvature that is greater than the first radius of curvature; and wherein at least one of the first golf club and the second golf club includes an adjustable hosel coupling and a removable sole member coupled to a sole portion of the respective golf club head configured to receive a removable sole member;

wherein the adjustable hosel coupling has an adjustment range of at least a first position and a second position;

the first position provides the golf club with a first adjusted lie angle, the second position provides the golf club with a second adjusted lie angle;

the first adjusted lie angle and second adjusted lie angle being different;

wherein in the first position, a first removable sole member is coupled to the sole portion of the golf club head and results in a first adjusted ground contact that is co-planar with a first adjusted center of gravity of the golf club in a vertical plane extending in a heel toe direction; and, wherein in the second position, a second removable sole member is coupled to the sole portion of the golf club head and results in a second adjusted ground contact that is co-planar with a second adjusted center of gravity of the golf club in a vertical plane extending in a heel toe direction.

10. The golf club of claim 9, wherein the first position further provides the golf club with a first adjusted face angle, the second position further provides the golf club with a second adjusted face angle;

the first adjusted face angle and second adjusted face angle being different.

11. The golf club of claim 9, wherein the first position further provides the golf club with a first adjusted bounce angle, the second position further provides the golf club with a second adjusted bounce angle;

the first adjusted bounce angle and second adjusted bounce angle being different.

12. A set of iron-type golf clubs, comprising:

a first golf club including a first golf club head having a first loft angle, a first ground contact that is co-planar with a first center of gravity of the golf club in a vertical plane extending in a heel-toe direction, and a first sole camber having a first radius of curvature;

a second golf club including a second golf club head having a second loft angle that is greater than the first loft angle, a second ground contact that is co-planar with a second center of gravity of the second golf club head in a vertical plane extending in a heel-toe direction, and a second sole camber having a second radius of curvature that is greater than the first radius of curvature; and wherein at least one of the first golf club and the second golf club includes an adjustable hosel coupling and a removable sole member coupled to a sole portion of the respective golf club head configured to receive a removable sole member;

wherein the adjustable hosel coupling has an adjustment range of at least a first position and a second position;

the first position provides the golf club with a first adjusted face angle, the second position provides the golf club with a second adjusted face angle;

the first adjusted face angle and second adjusted face angle being different;

wherein in the first position, a first removable sole member is coupled to the sole portion of the golf club head and results in a first adjusted ground contact that is co-planar with a first adjusted center of gravity of the golf club in a vertical plane extending in a heel toe direction; and, wherein in the second position, a second removable sole member is coupled to the sole portion of the golf club head and results in a second adjusted ground contact that is co-planar with a second adjusted center of gravity of the golf club in a vertical plane extending in a heel toe direction.

13. The golf club of claim 12, wherein the first position further provides the golf club with a first adjusted bounce angle, the second position further provides the golf club with a second adjusted bounce angle;

the first adjusted bounce angle and second adjusted bounce angle being different.

* * * * *